US009145241B2

(12) United States Patent
Ding et al.

(10) Patent No.: US 9,145,241 B2
(45) Date of Patent: Sep. 29, 2015

(54) THREADED CLOSURE ASSEMBLIES HAVING A HIGH APPLIED TORQUE TOLERANCE

(71) Applicant: SAINT-GOBAIN PERFORMANCE PLASTICS CORPORATION, Aurora, OH (US)

(72) Inventors: Ran Ding, Bolton, MA (US); Nicolau S. Cabral, North Dartmouth, MA (US); Mohammad Falaki, Assonet, MA (US); Robert J. Post, North Attleboro, MA (US); Gerald M. Pennington, Wesley Chapel, FL (US); Brandon J. Pennock, Midland, MI (US); Michael J. McCabe, Corona, CA (US); Khoa D. Pham, Pinellas Park, FL (US); Frank P. Jackson, Tauton, MA (US); Thomas R. Nixon, Au Gres, MI (US)

(73) Assignee: SAINT-GOBAIN PERFORMANCE PLASTICS CORPORATION, Aurora, OH (US)

( * ) Notice: Subject to any disclaimer, the term of this patent is extended or adjusted under 35 U.S.C. 154(b) by 0 days.

(21) Appl. No.: 14/301,697

(22) Filed: Jun. 11, 2014

(65) Prior Publication Data

US 2014/0367354 A1 Dec. 18, 2014

Related U.S. Application Data

(60) Provisional application No. 61/835,375, filed on Jun. 14, 2013.

(51) Int. Cl.
*B65D 51/14* (2006.01)

(52) U.S. Cl.
CPC ..... *B65D 51/145* (2013.01)

(58) Field of Classification Search
CPC ..... B65D 51/145; B65D 41/04; B65D 51/18; B65D 51/00; B65D 1/0246; B65D 1/023; B65D 39/086; B65D 39/082; B65D 39/08; B65D 41/08; B65D 41/38
USPC ..... 215/276, 274, 273, 283, 280, 356; 220/319, 315; 292/256.71, 299
See application file for complete search history.

(56) References Cited

U.S. PATENT DOCUMENTS

2007/0278256 A1 12/2007 Law et al.
2010/0155358 A1* 6/2010 George ..... 215/356

(Continued)

FOREIGN PATENT DOCUMENTS

JP 2008179409 A 8/2008
WO 02083518 A1 10/2002

OTHER PUBLICATIONS

The International Search Report and the Written Opinion received from the International Searching Authority (ISA/KR) for International Application No. PCT/US2014/041883, dated Oct. 7, 2014, 15 pages.

*Primary Examiner* — Robert J Hicks
(74) *Attorney, Agent, or Firm* — Abel Law Group, LLP; Chi Suk Kim

(57) ABSTRACT

The present application is directed to closure assemblies, and particularly closure assemblies for closing an opening in a vessel. In particular embodiments, the closure assemblies described herein can have a first ring having a top surface, an inner surface and an outer surface, wherein the outer surface comprises threading, wherein the first ring comprises a first flange having a top surface extending radially inward from the inner surface of the first ring a distance of $F_L$, and wherein the top surface of the first flange is spaced apart from the top surface of the first ring by a distance $F_H$, and wherein a ratio of $F_H$:$F_L$ is greater than 1.

19 Claims, 7 Drawing Sheets

(56) References Cited

U.S. PATENT DOCUMENTS

2011/0241262 A1 10/2011 Siddhamalli et al.
2012/0031905 A1 2/2012 Perez et al.
2012/0261416 A1 10/2012 Lin

* cited by examiner

THREADED CLOSURE ASSEMBLIES HAVING A HIGH APPLIED TORQUE TOLERANCE

CROSS-REFERENCE TO RELATED APPLICATION(S)

The present application claims priority from U.S. Provisional Patent Application No. 61/835,375 entitled "CLOSURE ASSEMBLY," by Ran Ding et al., filed Jun. 14, 2013, which is incorporated by reference herein in its entirety.

FIELD OF THE DISCLOSURE

The present disclosure relates to closure assemblies, and more particularly to, closure assemblies for closing an opening in a plastic or glass, and particularly a pyrex vessel.

RELATED ART

Closure assemblies, and particularly, split ring or split nut plastic closure assemblies can be used to close an opening in vessels, particularly vessels made from plastic or glass. Current designs of closure assemblies have many drawbacks. For example, current designs of closure assemblies can not achieve a high torque threshold, meaning that they can not withstand high applied torques. High applied torques are becoming increasingly necessary to provide proper sealing and closure of the opening of the vessel, especially when the fluid in the vessel is under pressure. Further, current designs do not enable complete engagement of the threadings in a closure assembly, leading to the inability to withstand high torque values. For example, during the rapid torqueing of the closure assembly, current designs can have failures such as jumping of the threading and miss-alignment of the closure assembly with respect to the opening of the vessel. Still further, failures can result from tilting of the closure assembly causing an uneven pressure application about the opening of the vessel.

Further improvements in closure assemblies are needed, particularly in enabling the closure assemblies to withstand high applied torques and achieve substantial engagement of the threadings. The following disclosure describes embodiments of a closure assembly which can overcome the disadvantages of the current designs and achieve excellent applied torque thresholds and improved threading engagement resulting in repeatable high performing closure assemblies.

BRIEF DESCRIPTION OF THE DRAWINGS

Embodiments are illustrated by way of example and are not limited in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the vessel sealing arts.

Figure 1:
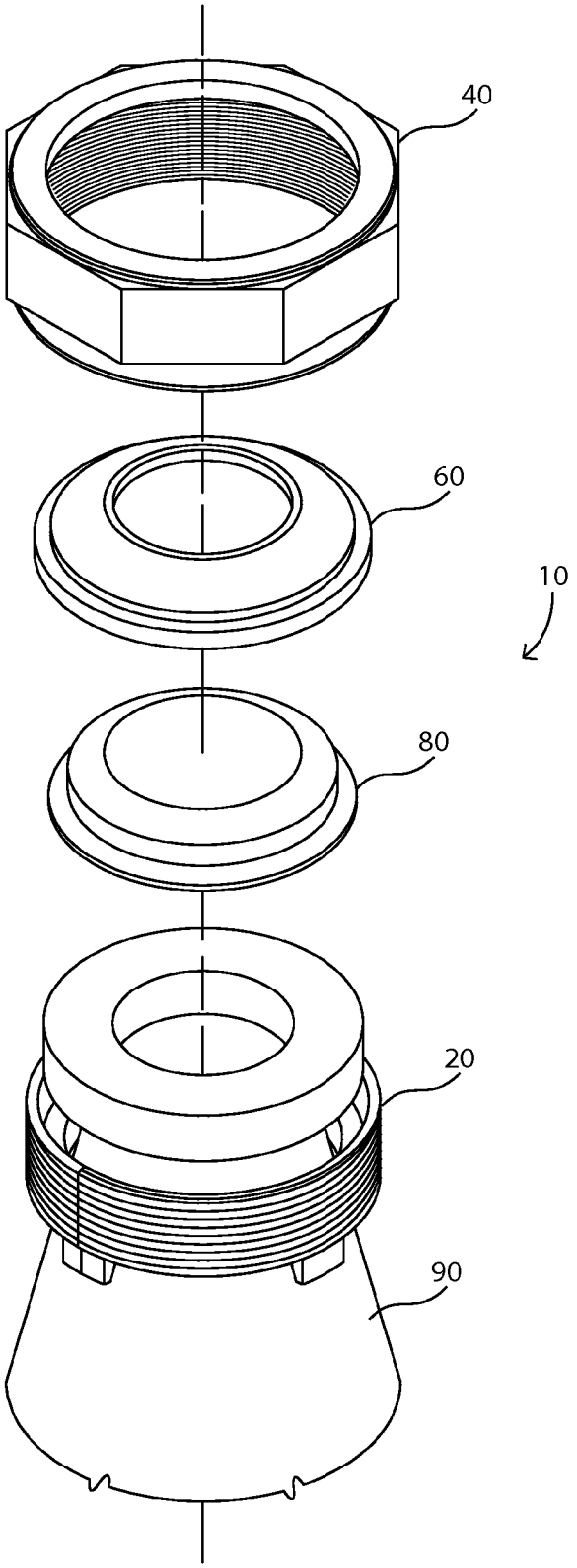
FIG. 1 illustrates an exploded view of a closure assembly according to an embodiment of the present disclosure.
Figure 2:
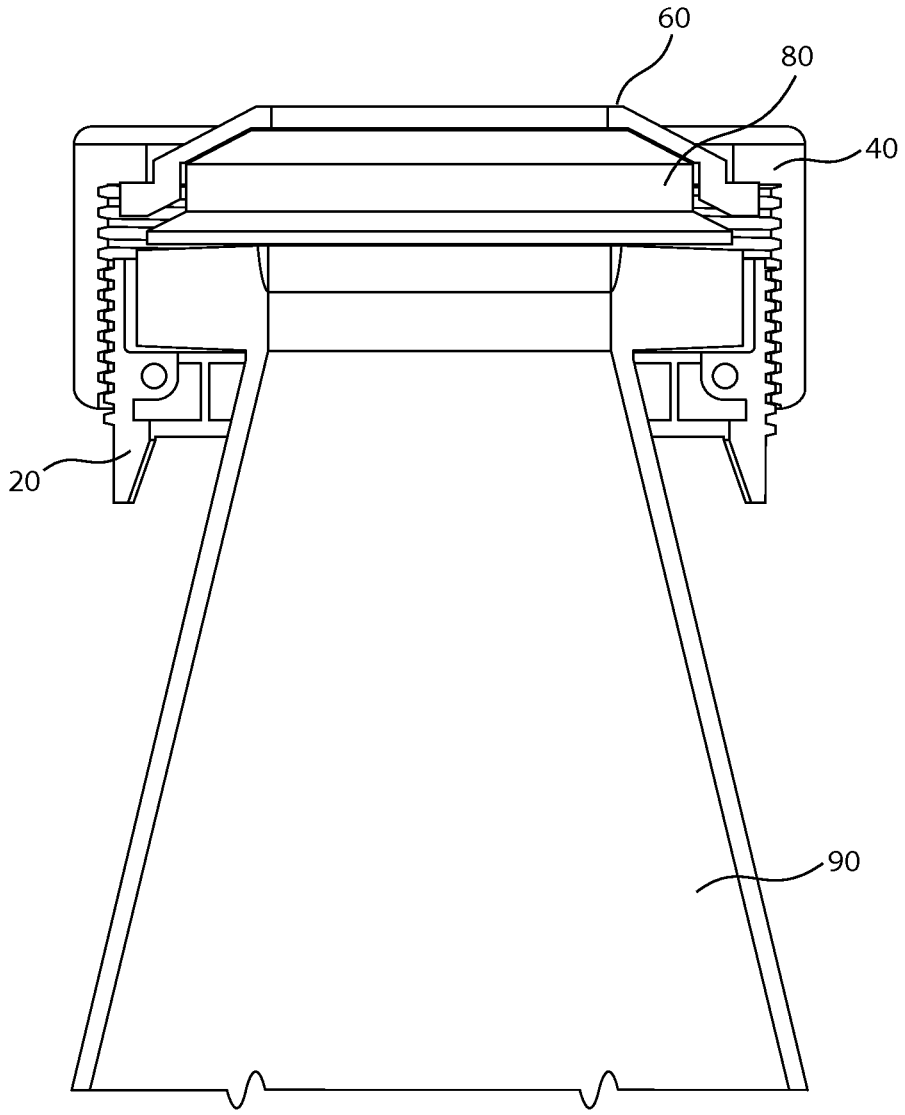
FIG. 2 illustrates a cross section view of an assembled closure assembly according to an embodiment of the present disclosure.

The following disclosure describes closure assemblies adapted to withstand high torque forces without disengagement of the threadings. For example, the present inventors have created a closure assembly capable of consistently withstanding torque forces of 180 in·lbf and greater, and allowing substantially full engagement of the threadings. The concepts are better understood in view of the embodiments described below that illustrate and do not limit the scope of the present invention FIG. 1 illustrates an exploded view of a closure assembly according to one embodiment of the present disclosure. The closure assembly 10 can include a first ring 20, a second ring 40, a first cap 60, and a second cap 80. The closure assembly can be adapted to engage with and close an opening 92 in a vessel 90. For example, FIG. 2 illustrates a cross section view of the closure assembly 10 shown in FIG. 1 in an assembled configuration.

In the certain embodiments, the first rind 20, second rind 40, first cap 60, second cap 80, or combinations thereof can be formed from a non-metal material, such as a plastic material, and in particular a polymer material. Specific examples of suitable polymer material include, but are not limited to, thermoplastic, thermosets, fluoropolymers, and combinations thereof. Specific examples of suitable polymer material can be polyvinyldiene fluoride (PVDF).

In particular embodiments, the first ring 20, second ring 40, first cap 60, second cap 80, or combinations thereof can be an injection molded component.

Figure 3A:
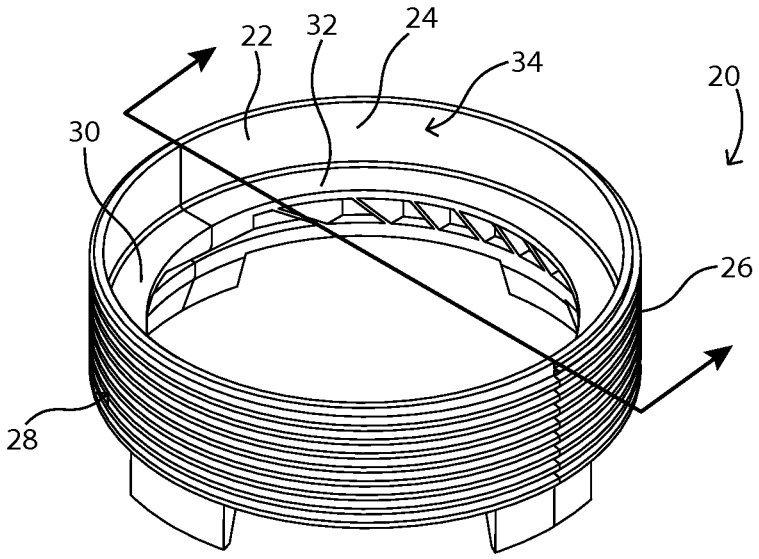
FIG. 3A illustrates a perspective view of a first ring according to an embodiment of the present disclosure.
Figure 3B:
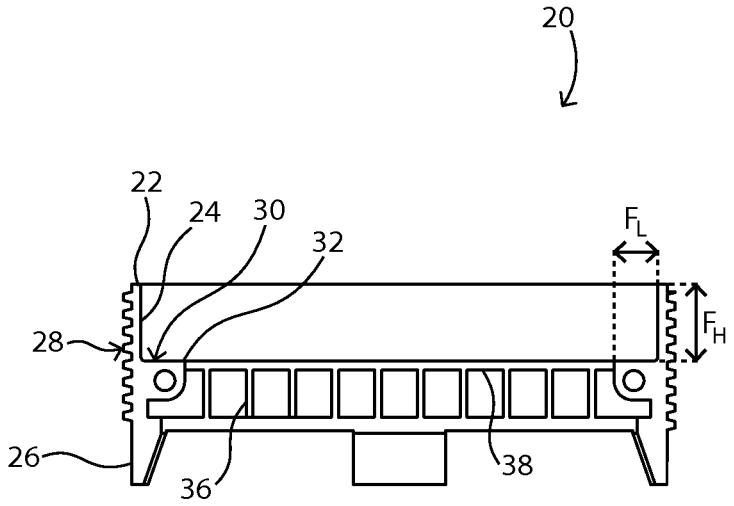
FIG. 3B illustrates a cross section of a first ring according to an embodiment of the present disclosure.

FIG. 3A illustrates a perspective view of a first ring 20 according to an embodiment, and FIG. 3B illustrates a cross section view of the first ring 20 shown in FIG. 3A. The first ring 20 can have a top surface 22, an inner surface 24, and an outer surface 26 and the outer surface 26 can include threading 28. In particular embodiments, the first ring 20 can include a first flange 30 having a top surface 32 extending radially inward from the inner surface 24 of the first ring 20 a distance of $F_L$. Furthermore, the top surface 32 of the first flange can be spaced apart from the top surface 22 of the first ring by a distance $F_H$.

In certain embodiments, a relationship of the first flange 30 in the first ring 20 can be defined by a ratio of $F_H$ $F_L$ In particular embodiments, a ratio of $F_H$:$F_L$ can be greater than 1, at least about 1.1, at least about 1.2, at least about 1.3, at least about 1.4, at least 1.5, at least about 1.6, at least about 1.7, at least about 1.8, at least about 1.9, at least about 2.0, at least about 2.5, at least about 3.0, or even at least about 5.0. In certain further embodiments, a ratio of $F_H$:$F_L$ can be no greater than about 20, no greater than about 10, no greater than about 5, or even no greater than about 3. The ratio of $F_H$:$F_L$ can also be within a range between any of the minimum and maximum values described above.

The first flange 30 can extend generally perpendicular to and radially inwardly from the inner surface 24 of the first ring 20. However, in certain embodiments, the first flange 30 can extend radially inwardly from the inner surface 24 of the first ring 20 at an angle in a range of from about 15 to 175 degrees.

A cavity 34 can be defined by the top surface 32 of the first flange 30 and the inner surface 24 of the first ring 20 above the first flange 30. In particular embodiments, the cavity 34 can be open and unfilled. For example, the cavity 34 can be adapted to directly engage with a vessel about its opening, and particularly, adapted to engage with a second flange disposed at an opening of a vessel. In certain embodiments, the cavity can have a profile adapted to substantially compliment an outer profile of a second flange disposed at an opening of a vessel.

The first ring 20 can further include a plurality of support ribs 36 in contact with a bottom surface 38 of the first flange 30 and the inner surface 24 of the first ring 20 below the bottom surface 38 of the first flange 30. The support ribs 36 serve to support the first flange 30 and provide it rigidity.

Figure 3C:
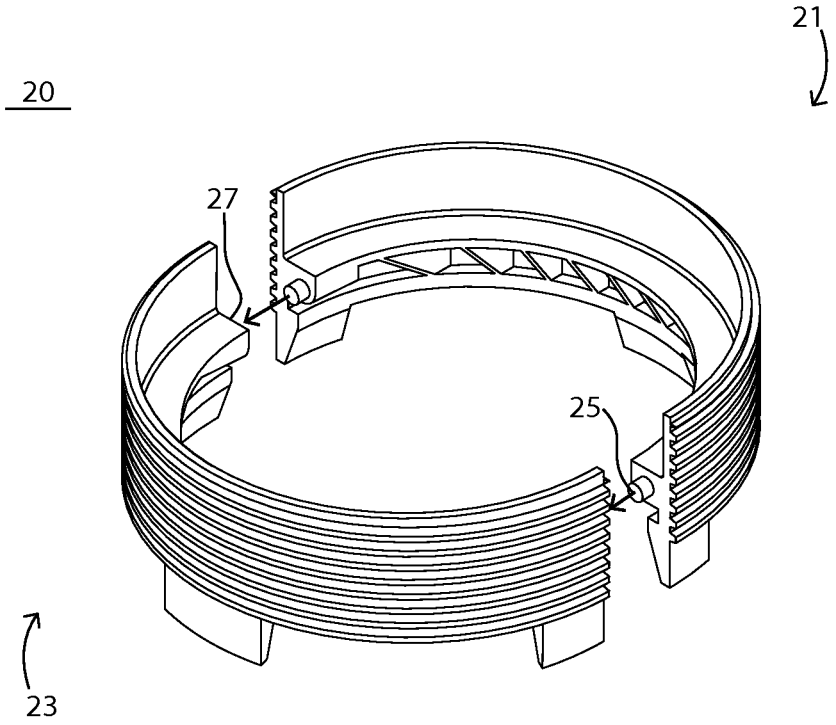
FIG. 3C illustrates a perspective view of the first ring illustrated in FIGS. 3A-3B, split into two halves according to an embodiment of the present disclosure.

Referring now to FIG. 3C, the first ring 20 can be a split ring, also referred to as a split-nut. For example, the first ring 20 can be adapted to be pulled apart in a plurality of pieces and reassembled about the neck of a vessel. In particular embodiments, and as illustrated in FIG. 3C, the split ring can include two pieces, a first half 21 and a second half 23. The two pieces can be configured to attach together in any suitable manner. For example, the first half 21 can include pegs 25, and the second half 23 can include corresponding holes 27 adapted to engage with the pegs 25.

Figure 4A:
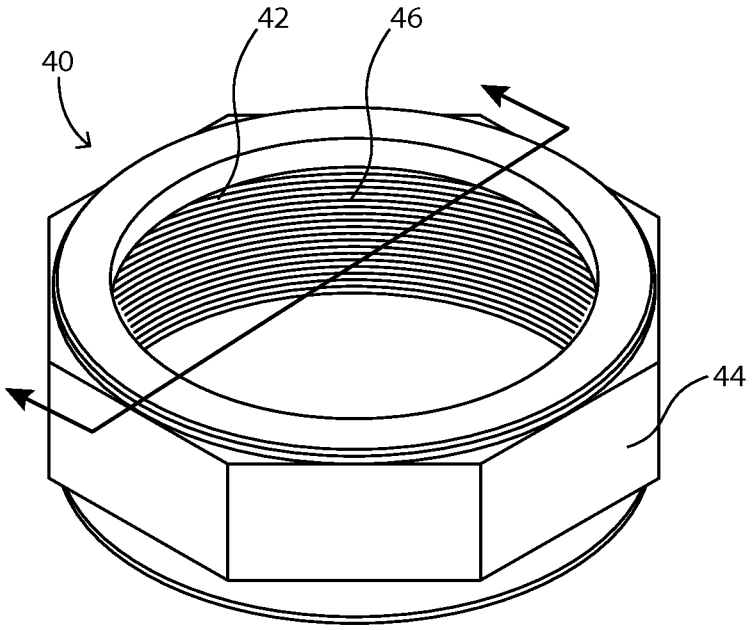
FIG. 4A illustrates a perspective view of a second ring according to an embodiment of the present disclosure.
Figure 4B:
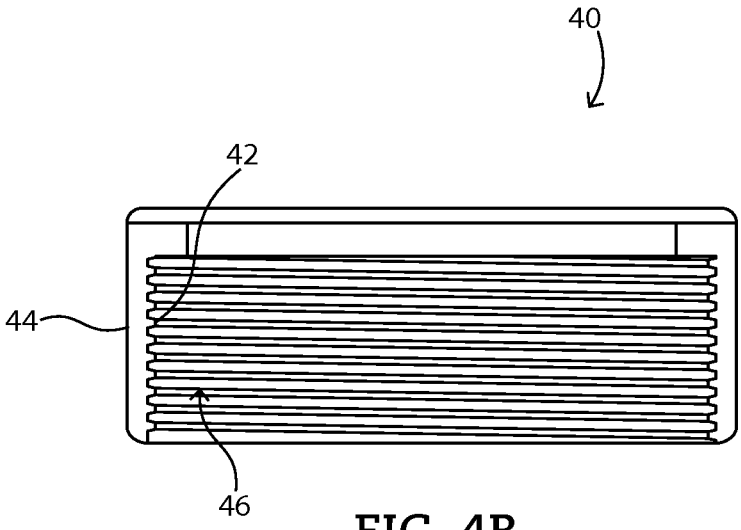
FIG. 4B illustrates a cross section of a second ring according to an embodiment of the present disclosure.

FIGS. 4A-4B illustrate a second ring 40 shown in the cross-section and perspective according to an embodiment of the present disclosure. The second ring 40 has an inner surface 42 and an outer surface 44, and threading 46 disposed on the outer surface 44. The threading 46 on the outer surface 44 of the second ring 40 can engage with the threading 28 on the outer surface 26 of the first ring 20.

In particular embodiments, the second ring 40 can be a monolithic or unitary ring. In other words, the second ring 40 can be a single piece. As illustrated in FIGS. 4A-4B, the second ring 40 can be in the form of a nut and adapted to engage with a torque wrench.

The second ring 40 can have an outer circumference including 4 sides, 5 sides, 6 sides, 7 sides, 8 sides, 9 sides, or even 10 sides.

The threading 28, 46 on the first ring 20, second ring 40, and combinations thereof can have any desired pitch. As used herein, pitch is referred to the liner distance between the crests of adjacent threads. In particular embodiments, the pitch can be defined in relation to the longest diameter of the second ring 40, as measured at the threadings. For example, a ratio of the diameter of the second ring 40 to the pitch of the threadings 28, 46 can be at least about 10, at least about 50, at least about 100, or even at least about 500. Further a ratio of the diameter of the screw to the pitch can be no greater than about 10,000, no greater than about 5,000, or even no greater than about 1,000. The ratio of the diameter of the second ring 40 to the pitch can also be within a range between any of the maximum and minimum values described above.

The threading 28, 46 on the first ring, second ring, and combinations thereof can also have a desired number of threads per inch, referred to herein as TPI. The threadings 28, 46 of the embodiments described herein can have a TPI of at least about 1 TPI, at least about 2 TPI, at least about 3 TPI, at least about 4 TPI, at least about 5 TPI, at least about 6 TPI, at least about 7 TPI, at least about 10 TPI, at least about 15 TPI, or even at least about 20 TPI. Further, the threadings 28, 46 have a threads per inch (TPI) of no greater than about 100 TPI, no greater than about 50 TPI, or even no greater than about 10 TPI. Moreover, the threadings 28, 46 can have a TPI within a range between any of the maximum and minim values described above.

The threadings 28, 46 can form a helical pattern about the outer surface 26 of the first ring 20 or inner surface 42 of the second ring 40. Further, the threadings 28, 46 can be described by the number of times the threads wrap around or within the first ring 20 or second ring 40. For example, a first threading would begin at the top of the outer surface 26 on the first ring 20, and after one complete rotation about the ring, the second threading would begin, and continue to wrap around the ring one complete rotation and then begin the third threading. The first, second, third, and remaining threadings can all for a single helical shaped threading. A particular advantage of the present disclosure is the location of the top surface 32 of the first flange 30 in relation to the threadings 28, 46. For example, in certain embodiments, the top surface 32 of the first flange 30 can be disposed below the first threading, the second threading, the third threading, the fourth threading, the fifth threading, the sixth threading, the seventh threading, the eight threading, the ninth threading, or even the tenth threading. As discussed above, the first threading is disposed nearest the top surface 22 of the first ring 20.

The closure assembly described herein can be used with any desired vessel 90. In particular embodiments, the vessel 90 can formed of a material including, metal, plastic, glass, or combinations thereof, and particularly pyrex. In certain embodiments, the vessel 90 can be formed of a material including plastic or glass.

Figure 5A:
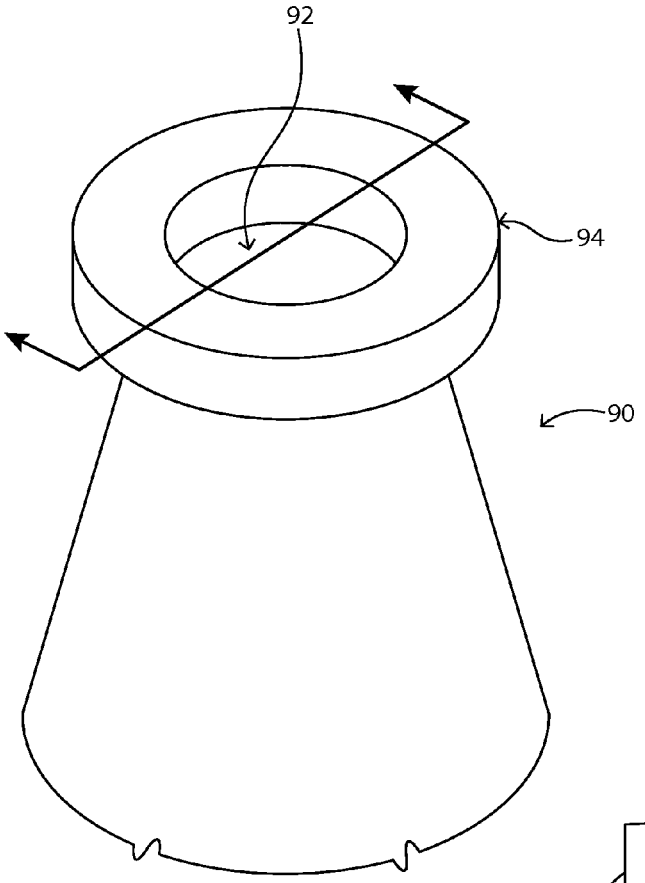
FIG. 5A illustrates a perspective view of a vessel according to an embodiment of the present disclosure.
Figure 5B:
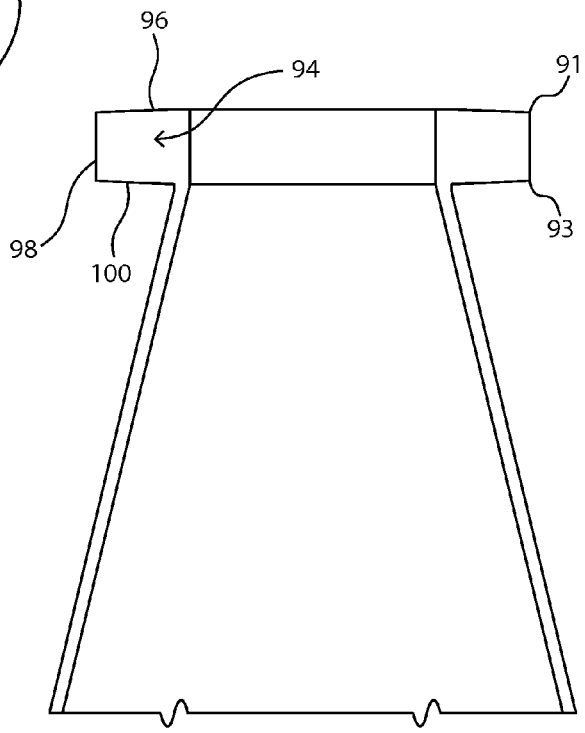
FIG. 5B illustrates a cross section of a vessel according to an embodiment of the present disclosure.

As particularly illustrated in FIGS. 5A-5B, the vessel can have a second flange 94 disposed near the opening 92 of the vessel. The second flange 94 can have a top surface 96, a side surface 98, and a bottom surface 100. As discussed above, the side surface 98 and bottom surface 100 of the second flange 94 on the vessel 90 can complement the cavity 34 defined by the inner surface 24 of the first ring 20 and top surface 32 of the first flange 30. In particular embodiments, the cavity 34 defined by the inner surface 24 of the first ring 20 and top surface 32 of the first flange 30 can be adapted to directly contact with the side surface 98 and bottom surface 100 of the second flange 94.

The inner surface 24 of the first ring 20 defined by the distance $F_H$ can be adapted to at least partially contact the side surface 98 of the second flange 94. In particular embodiments, the inner surface 24 of the first ring 20 defined by the distance $F_H$ is adapted to contact at least 10%, at least 20%, at least 30%, at least 40%, at least 50%, at least 60%, at least 70%, at least 80%, at least 85%, at least 90%, at least 95%, or even substantially all of the side surface 98 of the second flange 94.

Referring to FIG. 5B, which illustrates an enlarged cross-section view of the top of a vessel 90, the second flange 94 can have a bevel 91 between its top surface 96 and side surface 98. Further, the second flange 94 can have a second bevel 93 between the bottom surface 100 and the side surface 98.

Figure 6A:
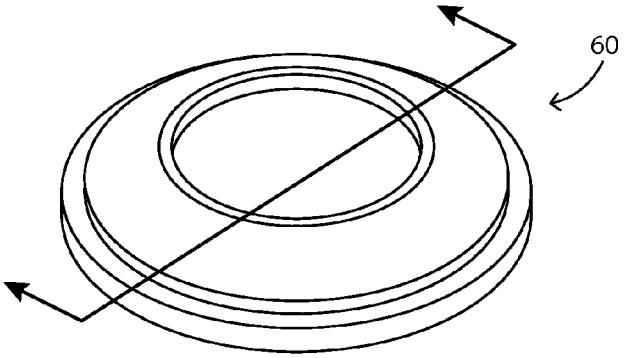
FIG. 6A illustrates a perspective view of a first cap according to an embodiment of the present disclosure.
Figure 6B:
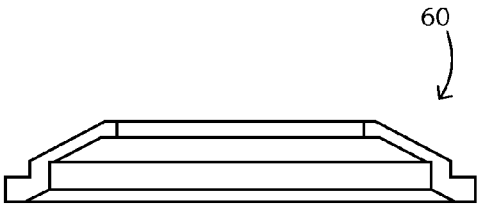
FIG. 6B illustrates a cross section of a first cap according to an embodiment of the present disclosure.

Referring now to FIGS. 6A-6B, the closure assembly can further include a first cap 60 adapted to be urged toward an opening in a vessel as the threadings on the first and second ring are engaged. The first cap 60 can be adapted to have an outer periphery to engage with the second ring, such that as the second ring engages with the first ring the assembly is tightened.

Figure 7A:
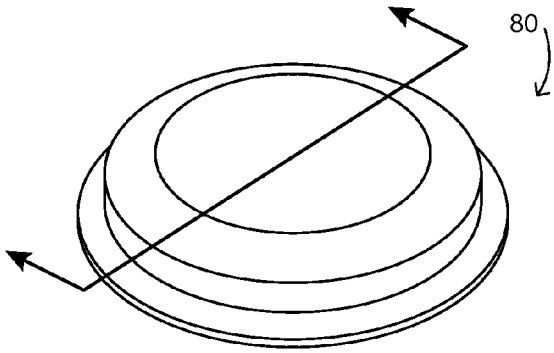
FIG. 7A illustrates a perspective view of a second cap according to an embodiment of the present disclosure.
Figure 7B:
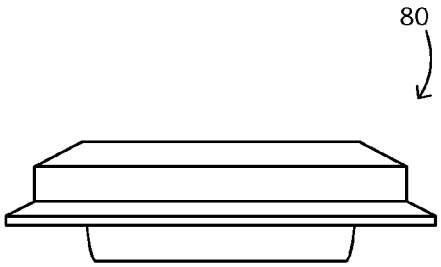
FIG. 7B illustrates a cross section of a second cap according to an embodiment of the present disclosure.

In further embodiments, as illustrated in FIGS. 7A-7B, the closure assembly can further include a second cap 80. The second cap 80 can be adapted to directly contact the opening of the vessel, and similar to the first cap 60, can be adapted to be urged toward the opening in a vessel as the threadings on the first and second rings are engaged. The second cap 80 can be formed of a flexible material, such as, for example a thermoplastic elastomer, silicone, or combinations thereof. For example, specific types of thermoplastic elastomers can be those described in U.S. Patent Application Publication No. 2011/0241262, which is incorporated herein by reference, in its entirety, for all useful purposes.

In particular embodiments, the first cap 60 can be harder or have a higher rigidity than the second cap 80, such that as the assembly is tightened, the second cap 80, which is directly adjacent the opening of the vessel, is deformed and provides a sealing structure.

A particular advantage of the closure assembly described herein is the ability to withstand higher applied torque forces than had been previously achieved. For example, embodiments of the closure assemblies described herein can have an Applied Torque Threshold (ATT) of at least about 150 in·lbf, at least about 160 in·lbf, at least about 170 in·lbf, at least about 180 in·lbf, at least about 190 in·lbf, at least about 200 in·lbf, at least about 210 in·lbf, at least about 220 in·lbf, at least about 230 in·lbf, at least about 240 in·lbf, at least about 250 in·lbf, at least about 260 in·lbf, at least about 275 in·lbf, at least about 300 in·lbf, or even at least about 500 in·lbf as measured according to THE APPLIED TORQUE THRESHOLD TEST. The applied torque threshold test is described in detail below in the Examples section. In particular, the applied torque threshold test is a measurement technique which describes the ability of the closure assembly to withstand an applied torque.

Another particular advantage of the closure assembly described herein is the level of engagement of the threadings. In certain embodiments, the closure assembly can have a desired threading engagement factor, referred to herein as TEF. The TEF is a quantification of the percentage of threads on the first and second ring in active engagement with each other in an assembled configuration after application of a desired torque. The threading engagement factor test is performed as described above in the applied torque threshold test, except that after the assembly has been torqued with a desired force, the percentage of the exposed threading on the first ring, if any, is measured, and the threading engagement factor is determined according to the following equation 1:

$$TEF=((D_{TT}-D_{ET})/(D_{TT}))*100\% \quad \text{Equation 1.}$$

wherein, TEF represents the threading engagement factor; $D_{ET}$ represents the linear distance of the exposed threading on the first ring; and $D_{TT}$ represents the total linear distance of the threading on the first ring.

In certain embodiments, the closure assembly described herein can have a TEF of at least about 50%, at least about 55%, at least about 60%, at least about 65%, at least about 70%, at least about 75%, at least about 80%, at least about 85%, at least about 90%, at least about 95%, or even at least about 99% as measured according to the "threading engagement factor test" at a torque pressure of 180 in·lbf. Furthermore, the closure assembly described herein can have a *TEF* of at least about 50%, at least about 55%, at least about 60%, at least about 65%, at least about 70%, at least about 75%, at least about 80%, at least about 85%, at least about 90%, at least about 95%, or even at least about 99% as measured according to "threading engagement factor test" at a torque pressure of 275 in·lbf.

Another particular advantage of the present disclosure is the ability to control the variability in the applied torque thresholds and the threading engagement factor. For example, a lot of closure assemblies described herein can each have the threading engagement factor, and/or applied torque threshold values described herein. In certain embodiments, the lot of closure assemblies can include at least 10 closure assemblies, at least 15 closure assemblies, at least 20 closure assemblies, at least 25 closure assemblies, or even at least 50 closure assemblies.

EXAMPLES

Example 1

Applied Torque Threshold (ATT)

10 Samples of example A, 10 samples of example B, and 10 samples of examples C were tested and compared for their ability to withstand different torque pressures, both before and after a sterilization cycle according to the applied torque threshold test and the threading engagement factor test, the details of which are provided below. The design of Examples A were obtained from Saint Gobain Performance Plastics, Garden Grove Division under the designation TCA-2, version 2. The design of Examples B were also obtained from Saint Gobain Performance Plastics, Garden Grove Division under the designation TCA-2—version 1. The design of Sample C is illustrated in FIG. 1.

Applied Torque Threshold Test Method

To determine whether a closure assembly can withstand a particular applied torque, the procedure below is followed:

a. Secure a fixture that simulates the bottle top onto a stable platform. In this instance, a mock-up of a pyrex No. 1595-2x (9.5 Liter) was used.
b. Next place the cap or caps to cover the opening on the mock-up.
c. Assemble the first ring around the neck of the vessel.
d. Hand screw the second ring to engage with the first ring.
e. Place a nut socket onto of the second ring.
f. Hold the first ring with a holder.
g. Preset a torque wrench to the desired torque.
h. Tighten the second ring with the torque wrench while at the same time holding the first ring with the holder.
i. Once the torque value has been reached, remove the torque wrench and visually observe the assembly for failures, particularly splitting of the first ring and disengagement of the threadings.
j. Using the torque wrench and holder, reverse the drive of the torque wrench and loosen the second ring and remove the cap and observe each piece of the assembly for failures, particularly damage to the threading.

Table 1 below illustrates the results of the Applied Torque Threshold Test on 10 samples of designs A, B, and C.

TABLE 1

| | Initial Torque | Initial Torque | Post Sterilization cycle | Post Sterilization cycle | Re-Torque after a Min. 4 hrs. delay | | |
|---|---|---|---|---|---|---|---|
| Sample | 150 in · lb | 180 in · lb | 150 in · lb | 180 in · lb | 150 in · lb | 180 in · lb | 275 in · lb |
| A1 | Pass | Pass | Pass | Pass | Pass | Pass | Fail |
| A2 | Pass | Pass | Pass | Fail | Fail | — | — |
| A3 | Pass | Pass | Pass | Pass | Pass | Fail | Fail |
| A4 | Pass | Pass | Pass | Pass | Pass | Pass | Pass |
| A5 | Pass | Pass | Pass | Pass | Pass | Pass | Pass |
| A6 | Pass | Pass | Pass | Fail | Fail | — | — |
| A7 | Pass | Pass | Pass | Pass | Pass | Pass | Pass |
| A8 | Pass | Pass | Pass | Pass | Pass | Pass | Fail |
| A9 | Pass | Pass | Pass | Pass | Pass | Pass | Fail |
| A10 | Pass | Pass | Pass | Pass | Pass | Pass | Fail |
| B1 | Pass | Pass | Pass | Pass | Pass | Pass | Pass |
| B2 | Pass | Pass | Pass | Pass | Pass | Pass | Pass |
| B3 | Pass | Pass | Pass | Pass | Pass | Pass | Pass |
| B4 | Pass | Pass | Pass | Fail | Fail | — | — |
| B5 | Pass | Pass | Pass | Pass | Pass | Pass | Pass |
| B6 | Pass | Pass | Pass | Pass | Pass | Pass | Fail |
| B7 | Pass | Pass | Pass | Pass | Pass | Pass | Pass |
| B8 | Pass | Pass | Pass | Pass | Pass | Pass | Pass |
| B9 | Pass | Pass | Pass | Pass | Pass | Pass | Pass |
| B10 | Pass | Pass | Pass | Pass | Pass | Pass | Pass |
| C1 | Pass | Pass | Pass | Pass | Pass | Pass | Pass |
| C2 | Pass | Pass | Pass | Pass | Pass | Pass | Pass |
| C3 | Pass | Pass | Pass | Pass | Pass | Pass | Pass |
| C4 | Pass | Pass | Pass | Pass | Pass | Pass | Pass |
| C5 | Pass | Pass | Pass | Pass | Pass | Pass | Pass |
| C6 | Pass | Pass | Pass | Pass | Pass | Pass | Pass |
| C7 | Pass | Pass | Pass | Pass | Pass | Pass | Pass |
| C8 | Pass | Pass | Pass | Pass | Pass | Pass | Pass |
| C9 | Pass | Pass | Pass | Pass | Pass | Pass | Pass |
| C10 | Pass | Pass | Pass | Pass | Pass | Pass | Pass |

As illustrated above, the design represented in the figures and described herein surprisingly exhibited an applied torque threshold of 150 in·lb, 180 in·lb, and 275 in·lb for each and every sample in the lot of samples, while failures were present in both comparative designs A and B.

Example 2

Threading Engagement Factor (TEF)

Samples B and C were then measured to determine their threading engagement factor (TEF). As discussed above, the threading engagement factor test is implemented identically to the applied torque threshold test, except that, before assembling the closure assembly, the linear distance of the threadings on the first ring are measured, and after assembling and applying the desired torque, the linear distance of the exposed threadings that are not in engagement with the threadings on the second ring is measured, and the threading engagement factor is determined according to Equation 1 detailed above.

The following results were obtained as illustrated in Table 2:

TABLE 2

| Sample | Total Thread Length | Exposed Thread Length | Threading Engagement Factor |
|---|---|---|---|
| B11 | 72 inches | 53.125 inches | 26% |
| C11 | 72 inches | 1.875 inches | 97% |

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the items as listed below.

Item 1. An assembly for closing an opening in a vessel, the assembly comprising:

a first ring having a top surface, an inner surface and an outer surface, wherein the outer surface comprises threading, wherein the first ring comprises a first flange having a top surface extending radially inward from the inner surface of the first ring a distance of $F_L$, and wherein the top surface of the first flange is spaced apart from the top surface of the first ring by a distance $F_H$, and wherein a ratio of $F_H$:$F_L$ is greater than 1.

Item 2. An assembly comprising:

a vessel having an opening and a second flange disposed about the opening, wherein the second flange has a top surface, a side surface, and a bottom surface;

a first ring having a top surface, an inner surface and an outer surface, wherein the outer surface comprises threading, wherein the first ring comprises a first flange extending radially inward from the inner surface of the first ring a distance of $L_L$, and wherein the top surface of the first flange is spaced apart from the top surface of the first ring by a distance H, wherein the surface of the first ring defined by the distance H is adapted to at least partially contact the side surface of the second flange;

a second ring having an inner surface and an outer surface, wherein the inner surface comprises threading; wherein the threading on the first ring and the threading on the second ring are adapted to engage with each other; and a first cap adapted to be urged toward an opening in a vessel when engaging the threadings.

Item 3. A split-nut closure assembly for closing a vessel, wherein the split-nut closure assembly has an Applied Torque Threshold (ATT) of at least 180 in·lbf as measured according to the applied torque threshold test.

Item 4. A split-nut closure assembly for closing an opening in a vessel, wherein the split-nut closure assembly has a threading engagement factor (TEF) of at least 50% as measured according to the threading engagement factor test at a torque pressure of 180 in·lbf.

Item 5. The assembly according to any one of the preceding items wherein the assembly comprises a first ring having a top surface, an inner surface and an outer surface, wherein the outer surface comprises threading, wherein the first ring comprises a first flange extending radially inward from the inner surface of the first ring a distance of $L_L$, and wherein the top surface of the first flange is spaced apart from the top surface of the first ring by a distance H.

Item 6. The assembly according to item 5, wherein a ratio of H:$L_L$ is at least about 1.1, at least about 1.2, at least about 1.3, at least about 1.4, at least 1.5, at least about 1.6, at least about 1.7, at least about 1.8, at least about 1.9, at least about 2.0, at least about 2.5, at least about 3.0, or even at least about 5.0.

Item 7. The assembly according to any one of items 5-6, wherein a ratio of H:$L_L$ is no greater than about 20, no greater than about 10, no greater than about 5, or even no greater than about 3.

Item 8. The assembly according to any one of items 5-7, wherein the first flange extends radially inwardly from the inner surface of the first ring at an angle of about 15 to 175 degrees.

Item 9. The assembly according to any one of items 5-8, wherein the first flange extends generally perpendicular to and radially inwardly from the inner surface of the first ring.

Item 10. The assembly according to any one of items 5-8, wherein a cavity is defined by the top surface of the first flange and the inner surface of the first ring above the first flange, and wherein the cavity is open and unfilled.

Item 11. The assembly according to any one of items 5-11, wherein a cavity is defined by the top surface of the first flange and the inner surface of the first ring above the first flange, and wherein the cavity is adapted to engage with a second flange disposed at an opening of a vessel.

Item 12. The assembly according to any one of items 5-11, wherein a cavity is defined by the top surface of the first flange and the inner surface of the first ring above the first flange, and wherein the cavity has a profile adapted to substantially compliment an outer profile of a second flange disposed at an opening of a vessel.

Item 13. The assembly according to any one of items 5-12, further comprising a plurality of support ribs in contact with a bottom surface of the first flange and the inner surface of the first ring.

Item 14. The assembly according to any one of items 5-13, wherein the first ring comprises a plastic material.

Item 15. The assembly according to any one of items 5-14, wherein the first ring comprises a polymer material.

Item 16. The assembly according to any one of items 5-15, wherein the first ring is an injection molded element.

Item 17. The assembly according to any one of items 5-16, wherein the first ring is a split ring.

Item 18. The assembly according to item 17, wherein the first ring comprises at least two pieces.

Item 19. The assembly according to item 17, wherein the first ring comprises two pieces.

Item 20. The assembly according to any one of the preceding items, wherein the assembly comprises a second ring having an inner surface and an outer surface, wherein the inner surface comprises threading.

Item 21. The assembly according to item 20, wherein the threading on the first ring and the threading on the second ring are adapted to engage with each other Item 22. The assembly according to any one of items 20-21, wherein the second ring is a monolithic ring.

Item 23. The assembly according to any one of items 20-22, wherein the second ring is adapted to engage with a torque wrench.

Item 24. The assembly according to any one of items 20-23, wherein the second ring has an outer circumference comprising 4 sides, 5 sides, 6 sides, 7 sides, 8 sides, 9 sides, or even 10 sides.

Item 25. The assembly according to any one of items 20-24, wherein the second ring comprises a plastic material.

Item 26. The assembly according to any one of items 20-25, wherein the second ring comprises a polymer material.

Item 27. The assembly according to any one of items 20-26, wherein the second ring is an injection molded element.

Item 28. The assembly according to any one of the preceding items, wherein the assembly comprises:

a first ring having a top surface, an inner surface and an outer surface, wherein the outer surface comprises threading; and a second ring having an inner surface and an outer surface, wherein the inner surface comprises threading;

wherein the threading on the first ring and the threading on the second ring are adapted to engage with each other.

Item 29. The assembly according to item 28, wherein the threadings have a threads per inch (TPI) of at least about 1 TPI, at least about 2 TPI, at least about 3 TPI, at least about 4

TPI, at least about 5 TPI, at least about 6 TPI, at least about 7 TPI, at least about 10 TPI, at least about 15 TPI, or even at least about 20 TPI.

Item 30. The assembly according to any one of items 28-29, wherein the threadings have a threads per inch (TPI) of no greater than about 100 TPI, no greater than about 50 TPI, or even no greater than about 10 TPI.

Item 31. The assembly according to any one of items 28-30, wherein, when viewed from a cross-section, the threadings on the first ring comprise a plurality of threadings, and the top surface of the first flange is disposed below the first threading, the second threading, the third threading, the fourth threading, the fifth threading, the sixth threading, or even the seventh threading, and wherein the first threading is disposed nearest the top surface of the first ring.

Item 32. The assembly according to any one of the preceding items, wherein the assembly comprises a vessel having an opening and a second flange disposed about the opening, wherein the second flange has a top surface, a side surface, and a bottom surface.

Item 33. The assembly according to item 32, wherein when the threading is engaged, the first ring is in direct contact with the side surface and bottom surface of the second flange.

Item 34. The assembly according to any one of items 32-33, wherein the assembly comprises a first ring having a top surface, an inner surface and an outer surface, wherein the outer surface comprises threading, wherein the first ring comprises a first flange extending radially inward from the inner surface of the first ring a distance of $L_L$, and wherein the top surface of the first flange is spaced apart from the top surface of the first ring by a distance H, wherein the surface of the first ring defined by the distance H is adapted to at least partially contact the side surface of the second flange.

Item 35. The assembly according to item 34, wherein the surface of the first ring defined by the distance H is adapted to contact at least 10%, at least 20%, at least 30%, at least 40%, at least 50%, at least 60%, at least 70%, at least 80%, at least 85%, at least 90%, at least 95%, or even substantially all of the side surface of the second flange.

Item 36. The assembly according to any one of items 32-35, wherein the second flange has a bevel between the top surface and the side surface; and/or wherein the second flange has a bevel between the bottom surface and the side surface.

Item 37. The assembly according to any one of items 32-36, wherein the vessel comprises glass or pyrex.

Item 38. The assembly according to any one of the preceding items, wherein the assembly comprises a first cap.

Item 39. The assembly according to item 38, wherein the first cap is adapted to be urged toward an opening in a vessel as the threadings are engaged.

Item 40. The assembly according to any one of items 38-39, further comprising a second cap, and wherein the first cap is harder than the second cap.

Item 41. The assembly according to any one of items 38-40, further comprising a second cap, and wherein the second cap has a higher rigidity than the second cap.

Item 42. The assembly according to any one of items 38-41, wherein the first cap is the uppermost element of the closure assembly.

Item 43. The assembly according to any one of the preceding items, further comprising a second cap.

Item 44. The assembly according to item 43, wherein the second cap is adapted to be urged toward an opening in a vessel as the threadings are engaged.

Item 45. The assembly according to any one of items 43-44, wherein the second cap directly contacts the opening of the vessel.

Item 46. The assembly according to any one of items 43-45, wherein the second cap is adapted to directly contact the opening of the vessel and the first cap.

Item 47. The assembly according to any one of items 43-46, wherein the second cap comprises silicone.

Item 48. The assembly according to any one of the preceding items, wherein the closure assembly has a threading engagement factor of at least about 50%, at least about 55%, at least about 60%, at least about 65%, at least about 70%, at least about 75%, at least about 80%, at least about 85%, at least about 90%, at least about 95%, or even at least about 99% as measured according to the threading engagement factor test at a torque pressure of 180 in·lbf or even at a torque pressure of 275 in·lbf.

Item 49. A lot of at least ten closure assemblies according to any one of the preceding items, wherein each of the closure assemblies in the lot of ten closure assemblies has a threading engagement factor of at least about 50%, at least about 55%, at least about 60%, at least about 65%, at least about 70%, at least about 75%, at least about 80%, at least about 85%, at least about 90%, at least about 95%, or even at least about 99% as measured according to the threading engagement factor test at a torque pressure of 180 in·lbf or even at a torque pressure of 275 in·lbf.

Item 50. The assembly according to any one of the preceding items, wherein the assembly has an applied torque threshold of at least about 150 in·lbf, at least about 160 in·lbf, at least about 170 in·lbf, at least about 180 in·lbf, at least about 190 in·lbf, at least about 200 in·lbf, at least about 210 in·lbf, at least about 220 in·lbf, at least about 230 in·lbf, at least about 240 in·lbf, at least about 250 in·lbf, at least about 260 in·lbf, at least about 275 in·lbf, at least about 300 in·lbf, or even at least about 500 in·lbf as measured according to the applied torque threshold test.

Item 51. A lot of at least ten closure assemblies according to any one of the preceding items, wherein each of the closure assemblies in the lot of ten closure assemblies has an applied torque threshold of at least about 150 in·lbf, at least about 160 in·lbf, at least about 170 in·lbf, at least about 180 in·lbf, at least about 190 in·lbf, at least about 200 in·lbf, at least about 210 in·lbf, at least about 220 in·lbf, at least about 230 in·lbf, at least about 240 in·lbf, at least about 250 in·lbf, at least about 260 in·lbf, at least about 275 in·lbf, at least about 300 in·lbf, or even at least about 500 in·lbf as measured according to the applied torque threshold test.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. An assembly for closing an opening in a vessel, the assembly comprising:

a first ring having a top surface, an inner surface and an outer surface, wherein the outer surface comprises threading, wherein the first ring comprises a first flange having a top surface extending radially inward from the inner surface of the first ring a distance of $F_L$, wherein the top surface of the first flange is spaced apart from the top surface of the first ring by a distance $F_H$, and wherein a ratio of $F_H$:$F_L$ is greater than 1, wherein a cavity is defined by the top surface of the first flange and the inner surface of the first ring above the first flange, and wherein the cavity is open and unfilled;

a second ring having an inner surface and an outer surface, wherein the inner surface comprises threading;

wherein the threading on the first ring and the threading on the second ring are adapted to engage with each other; and wherein the first ring is a split ring.

2. The assembly according to claim 1, wherein the first flange extends radially inwardly from the inner surface of the first ring at an angle of about 15 to 175 degrees.

3. The assembly according to claim 1, wherein the cavity is adapted to engage with a second flange disposed at an opening of a vessel.

4. The assembly according to claim 1, wherein the cavity has a profile adapted to substantially compliment an outer profile of a second flange disposed at an opening of a vessel.

5. The assembly according claim 1, further comprising a plurality of support ribs in contact with a bottom surface of the first flange and the inner surface of the first ring.

6. The assembly according to claim 1, wherein the threadings have a threads per inch (TPI) of at least about 3 TPI.

7. The assembly according to claim 6, wherein, when viewed from a cross-section, the threadings on the first ring comprise a plurality of threadings adjacent each other including a first threading, a second threading, a third threading, and a fourth threading, and the top surface of the first flange is disposed below a fourth threading.

8. The assembly according to claim 1, wherein the assembly comprises a vessel having an opening and a second flange disposed about the opening, wherein the second flange has a top surface, a side surface, and a bottom surface, and wherein when the threading is engaged, the first ring is in direct contact with the side surface and bottom surface of the second flange.

9. The assembly according to claim 8, wherein the first flange extends radially inward from the inner surface of the first ring a distance of $L_L$, and wherein the top surface of the first flange is spaced apart from the top surface of the first ring by a distance H, wherein the surface of the first ring defined by the distance H is adapted to at least partially contact the side surface of the second flange.

10. The assembly according to claim 1, wherein the assembly comprises a first cap and a second cap, wherein the first cap is adapted to be urged toward an opening in a vessel as the threadings are engaged, and wherein the first cap is harder than the second cap.

11. The assembly according to claim 1, wherein the closure assembly has a threading engagement factor (TEF) of at least about 70% as measured according to the threading engagement factor test at a torque pressure of 180 in·lbf.

12. An assembly for closing an opening in a vessel, the assembly comprising:

a first ring having a top surface, an inner surface and an outer surface, wherein the outer surface comprises threading, wherein the first ring comprises a first flange having a top surface extending radially inward from the inner surface of the first ring a distance of $F_L$, wherein the top surface of the first flange is spaced apart from the top surface of the first ring by a distance $F_H$, and wherein a ratio of $F_H$:$F_L$ is greater than 1, wherein a cavity is defined by the top surface of the first flange and the inner surface of the first ring above the first flange, and wherein the cavity has a profile adapted to substantially compliment an outer profile of a second flange disposed at an opening of a vessel;

a second ring having an inner surface and an outer surface, wherein the inner surface comprises threading;

wherein the threading on the first ring and the threading on the second ring are adapted to engage with each other; and wherein the first ring is a split ring.

13. The assembly according to claim 12, wherein the threadings have a threads per inch (TPI) of at least about 3 TPI.

14. The assembly according to claim 12, wherein the cavity is open and unfilled.

15. The assembly according to claim 12, wherein the first flange extends radially inwardly from the inner surface of the first ring at an angle of about 15 to 175 degrees.

16. The assembly according to claim 12, wherein the assembly has a threading engagement factor (TEF) of at least about 70% as measured according to the threading engagement factor test at a torque pressure of 180 in·lbf.

17. The assembly according claim 12, further comprising a plurality of support ribs in contact with a bottom surface of the first flange and the inner surface of the first ring.

18. The assembly according to claim 12, wherein the assembly comprises a vessel having an opening and a second flange disposed about the opening, wherein the second flange has a top surface, a side surface, and a bottom surface, and wherein when the threading is engaged, the first ring is in direct contact with the side surface and bottom surface of the second flange.

19. An assembly for closing an opening in a vessel, the assembly comprising:

a first ring having a top surface, an inner surface and an outer surface, wherein the outer surface comprises threading, wherein the first ring comprises a first flange having a top surface extending radially inward from the inner surface of the first ring a distance of $F_L$, wherein the top surface of the first flange is spaced apart from the top surface of the first ring by a distance $F_H$, and wherein a ratio of $F_H$:$F_L$ is greater than 1, wherein a cavity is defined by the top surface of the first flange and the inner surface of the first ring above the first flange, and wherein the cavity is open and unfilled;

a second ring having an inner surface and an outer surface, wherein the inner surface comprises threading, wherein the first ring is a split ring, and wherein the threading on the first ring and the threading on the second ring are adapted to engage with each other;

a first cap and a second cap, wherein the first cap is adapted to be urged toward an opening in a vessel as the threadings are engaged, and wherein the first cap is harder than the second cap.

* * * * *

UNITED STATES PATENT AND TRADEMARK OFFICE

CERTIFICATE OF CORRECTION

PATENT NO. : 9,145,241 B2
APPLICATION NO. : 14/301697
DATED : September 29, 2015
INVENTOR(S) : Ran Ding et al.

It is certified that error appears in the above-identified patent and that said Letters Patent is hereby corrected as shown below:

In the Specification

Column 3, Line 12: please replace the phrase “first rind 20” with “first ring 20”.

Column 3, Lines 12-13: please replace the phrase “second rind 40” with “second ring 40”.

In the Claims

Column 14, Line 4: please remove the word “closure”.

Signed and Sealed this
Tenth Day of May, 2016

Michelle K. Lee

Michelle K. Lee
*Director of the United States Patent and Trademark Office*